US009305723B2

(12) United States Patent
Liu et al.

(10) Patent No.: US 9,305,723 B2
(45) Date of Patent: Apr. 5, 2016

(54) STRIP TYPE OFF-CIRCUIT TAP CHANGER

(71) Applicant: WUHAN TAIPU TRANSFORMER CHANGER CO., LTD., Wuhan (CN)

(72) Inventors: Gang Liu, Wuhan (CN); Zhi-Biao Ding, Wuhan (CN); Zhi-Jiang Xu, Wuhan (CN)

(73) Assignee: WUHAN TAIPU TRANSFORMER CHANGER CO., LTD., Wuhan (CN)

( * ) Notice: Subject to any disclaimer, the term of this patent is extended or adjusted under 35 U.S.C. 154(b) by 399 days.

(21) Appl. No.: 13/912,606

(22) Filed: Jun. 7, 2013

(65) Prior Publication Data

US 2014/0048394 A1 Feb. 20, 2014

(30) Foreign Application Priority Data

Aug. 20, 2012 (CN) ..... 2012 1 0295622

(51) Int. Cl.

| | |
|---|---|
| ***H01H 19/00*** | (2006.01) |
| ***H01H 21/00*** | (2006.01) |
| ***H01H 19/02*** | (2006.01) |
| ***H01H 9/00*** | (2006.01) |
| ***H01H 15/08*** | (2006.01) |

(52) U.S. Cl.

CPC ..... *H01H 19/02* (2013.01); *H01H 9/0016* (2013.01); *H01H 15/08* (2013.01)

(58) Field of Classification Search

CPC ..... H01F 29/00; H01F 29/04; H01H 1/00; H01H 1/56; H01H 19/00; H01H 21/00; H01H 3/00; H01H 3/02; H01H 3/22; H01H 3/32; H01H 3/54; H01H 69/00; H01H 71/00; H01H 71/02; H01H 71/10; H01H 71/12; H01H 71/50; H01H 71/52; H01H 73/00; H01H 73/02; H01H 73/04; H01H 75/00; H01H 77/00; H01H 83/00; H01H 2001/00; H01H 2001/12; H01H 2001/20; H01H 2001/36; H01H 2001/58; H01H 2003/00; H01H 2003/02; H01H 33/666; H01H 2009/00; H01H 2009/0005; H01H 2009/0016; H01H 2009/0044; H01H 2009/0088; H01H 2009/0094

USPC ..... 200/11 TC; 336/150

See application file for complete search history.

(56) References Cited

FOREIGN PATENT DOCUMENTS

| | | | | |
|---|---|---|---|---|
| CN | 201126756 Y | | 10/2008 | |
| JP | 62263620 A | * | 11/1987 | ..... H01F 29/04 |

* cited by examiner

*Primary Examiner* — Renee Luebke
*Assistant Examiner* — Anthony R. Jimenez
(74) *Attorney, Agent, or Firm* — Tim Tingkang Xia, Esq.; Locke Lord LLP

(57) ABSTRACT

One aspect of the present invention, a strip type off-circuit tap changer includes an insulating rod and a support, where an operation positioning device is arranged on the support, a rack mobile frame is disposed on the insulating rod, the rack of the rack mobile frame is engaged to a drive gear of the operation positioning device, columnar fixed contacts are longitudinally arranged at a spacing on the insulating rod, the rack mobile frame is connected to a moving contact frame, and a moving contact assembly is arranged on the moving contact frame and fits with the fixed contacts on the insulating rod, the moving contact assembly is formed by an annular moving contact and an elastic pin, and the annular moving contact spans between two adjacent columnar fixed contacts.

13 Claims, 8 Drawing Sheets

STRIP TYPE OFF-CIRCUIT TAP CHANGER

CROSS-REFERENCE TO RELATED APPLICATION

This application claims the priority to Chinese Patent Application No. CN201210295622.2, filed Aug. 20, 2012, in the State Intellectual Property Office of P.R. China, which is hereby incorporated herein in its entirety by reference.

FIELD OF THE INVENTION

The present invention relates to a strip type off-circuit tap changer for a transformer.

BACKGROUND OF THE INVENTION

Chinese Patent No. CN201126756Y discloses a strip type off-circuit tap changer, where a contact set has moving contacts and fixed contacts. The moving contact is clip-type, and two upper and lower moving contacts closely press and span over a fixed contact with a spring or a reed, such that when the switch is shifted, the upper and lower moving contacts slide on the fixed contact. The foregoing structure has the following shortcomings: the frictional resistance is great and has no handleability when the moving contacts slide on the fixed contact, the moving and the fixed contacts have great abrasion, which cannot avoid a transmission error in the operation positioning, and results in low operational reliability.

Therefore, a heretofore unaddressed need exists in the art to address the aforementioned deficiencies and inadequacies.

SUMMARY OF THE INVENTION

One of the objectives of the present invention is to provide a strip type off-circuit tap changer with reliable contact, correct positioning, and highly reliable operation, so as to overcome the shortcomings in the prior art.

In one aspect of the present invention, a strip type off-circuit tap changer includes an insulating rod and a support. An operation positioning device is arranged on the support, a rack mobile frame is disposed on the insulating rod, the rack of the rack mobile frame is engaged to a drive gear of the operation positioning device, columnar fixed contacts are longitudinally arranged at a spacing on the insulating rod, the rack mobile frame is connected to a moving contact frame, and a moving contact assembly is arranged on the moving contact frame and fits with the fixed contact on the insulating rod; the moving contact assembly is formed by an annular moving contact and an elastic pin, and the annular moving contact spans between two adjacent columnar fixed contacts.

In one embodiment, the elastic pin is arranged in the annular moving contact, the annular moving contact closely contacts the columnar fixed contact by imposing a radial elastic force on an inner ring, and the elastic pin is formed by a sliding pin and a return spring.

In one embodiment, the elastic pin is arranged out of the annular moving contact, the annular moving contact closely contacts the columnar fixed contact by imposing a radial elastic force on an outer ring, and the elastic pin is formed by a sliding pin and a return spring.

In one embodiment, a rear section of the sliding pin fits with a sliding hole of the moving contact frame, a front end of the sliding pin fits with the annular moving contact, and the return spring is sleeved outside the sliding pin.

In one embodiment, the moving contact frame is arranged with a cantilever bent downwards, and a sliding slot is opened at an inner side of the cantilever and fits with a lower end of the insulating rod in a sliding manner.

In one embodiment, the columnar fixed contact is in a shape of a cylinder or a flat column.

In one embodiment, the columnar fixed contacts longitudinally arranged at a spacing along the insulating rod is in a shape of a straight strip, and penetrate the insulating rod; the annular moving contact is disposed at an upper side of the columnar fixed contact, and the moving contact corresponds to the fixed contact up and down.

In one embodiment, the columnar fixed contacts longitudinally arranged at a spacing along the insulating rod are in a bent shape, and one end thereof is bent upwards after penetrating the insulating rod; the annular moving contact is disposed outside the end, bent upwards, of the columnar fixed contact, and the moving contact corresponds to the fixed contact front and back.

In one embodiment, the other end of the columnar fixed contact is a wiring column end.

In one embodiment, one to three sets of columnar fixed contacts are arranged, and each set is correspondingly disposed with a moving contact assembly, to form one to three sets of tap mechanisms.

The beneficial effects of the present invention are as follows: (1). the gear shifting of the moving contact is performed in a rolling displacement manner instead of the sliding displacement manner by using the annular moving contact, which not only reduces the frictional resistance during the moving of the moving contact, but also reduces the abrasion between the moving contact and the fixed contact, thereby prolonging the effective service life of the tap switch; (2). the annular moving contact spans between two adjacent columnar fixed contacts, so the moving contact and the fixed contact are reliably in contact with each other; the annular moving contact can be automatically homed, which achieves correct positioning; and since the moving contact has large traversing range when longitudinally moving during gear shifting and obvious handleability is achieved during the gear shifting, the operational reliability is high; and (3). the present invention has a simple and compact structure and is appropriately designed.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment.

DETAILED DESCRIPTION OF THE INVENTION

Figure 1:
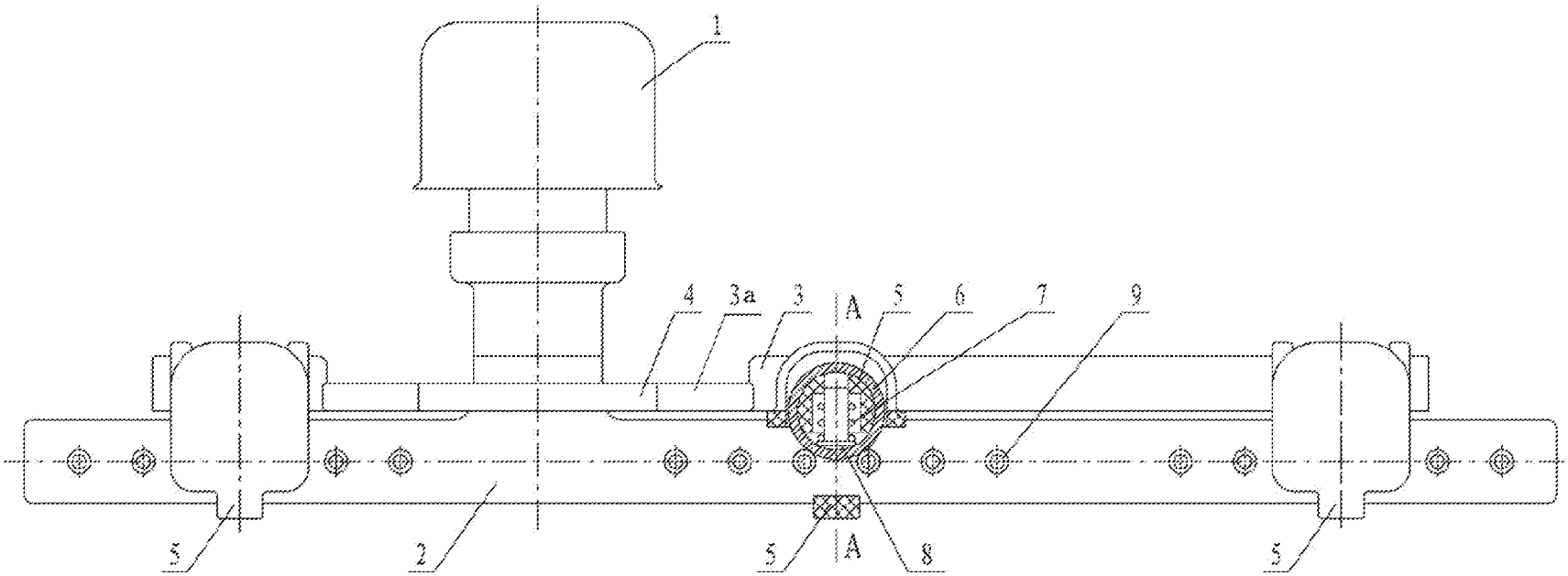
FIG. 1 is a front view of a strip type off-circuit tap changer according to a first embodiment of the present invention.

The present invention is more particularly described in the following examples that are intended as illustrative only since numerous modifications and variations therein will be apparent to those skilled in the art. Various embodiments of this invention are now described in detail in conjunction with the accompanying drawings. Referring to the drawings, like numbers indicate like components throughout the views.

In accordance with the purposes of this invention, as embodied and broadly described herein, this invention, in one aspect, relates to a strip type off-circuit tap changer. The embodiments of the present invention are described in detail below with reference to the accompanying drawings of FIGS. 1-8.

Figure 2:
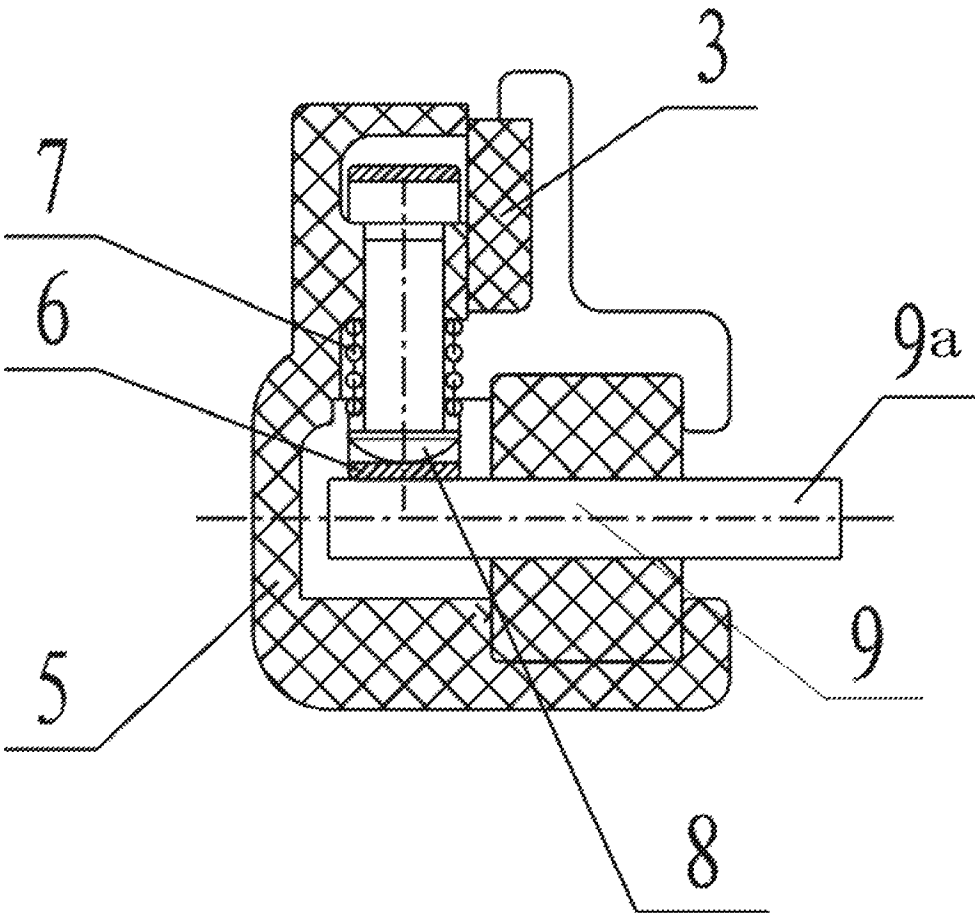
FIG. 2 is an A-A sectional view of the strip type off-circuit tap changer shown in FIG. 1.

Referring to FIGS. 1 and 2, a strip type off-circuit tap changer is shown according to a first embodiment of the present invention. In the embodiment, the strip type off-circuit tap changer includes a long-strip insulating rod 2 with a section being a rectangle, a support 3 *a* is connected to the insulating rod 2, and an operation positioning device 1 is arranged on the support 3*a* ; a drive gear 4 is disposed at a lower end of the operation positioning device 1, a rack mobile frame 3 is disposed at an upper side of the insulating rod 2, and a rack of the rack mobile frame 3 is engaged to the gear of the operation positioning device 1, so that the rack mobile frame 3 can longitudinally move along the insulating rod 2. Columnar fixed contacts 9 are longitudinally arranged at a space on the insulating rod 2. The columnar fixed contact 9 is cylindrical and in a shape of a straight strip, and penetrates the insulating rod 2. Three sets of columnar fixed contacts 9 are arranged, each set is disposed with four to ten columnar fixed contacts 9, where the columnar fixed contacts 9 in each set are equally spaced from each other. An end 9*a* of the columnar fixed contact 9 is a wiring column end, the columnar fixed contact sets are spaced by a large distance, and each set is correspondingly disposed with a moving contact assembly, to form three sets of tap mechanisms. The rack mobile frame 3 is connected to three moving contact frames 5, the moving contact frame 5 is arranged with a cantilever bent downwards, and a sliding slot is opened at an inner side of the cantilever and fits with a lower end of the insulating rod in a sliding manner. A moving contact assembly is arranged on the moving contact frame 5 and fits with the fixed contact 9 on the insulating rod 2. The moving contact assembly is formed by an annular moving contact 6 and an elastic pin. The annular moving contact 6 spans between two adjacent columnar fixed contacts 9. The annular moving contact 6 is disposed at an upper side of the columnar fixed contact 9, such that the moving contact and the fixed contact are corresponding to each other in an up-and-down form. The elastic pin is arranged in the annular moving contact 6, and is formed by a sliding pin 8 and a return spring 7. A rear section of the sliding pin 8 fits with a sliding hole of the moving contact frame 5, and an end head with a large diameter at a front end of the sliding pin 8 fits with an inner ring of the annular moving contact 6. The return spring 7 is sleeved out of the sliding pin 8, located between a sliding hole end face and the sliding pin end head, and enables the annular moving contact 6 to closely contact the columnar fixed contact 9 by imposing a radial elastic force on the inner ring of the annular moving contact 9.

When it is required to shift the gear, the operation positioning device 1 is activated to drive the drive gear 4 to rotate to drive the rack mobile frame 3 to longitudinally move; the rack mobile frame drives the moving contact frame 5 to move back and forth on the insulating rod, so as to drive the annular moving contact to roll on the columnar fixed contact, thereby implementing the gear shifting of the switch.

Figure 3:
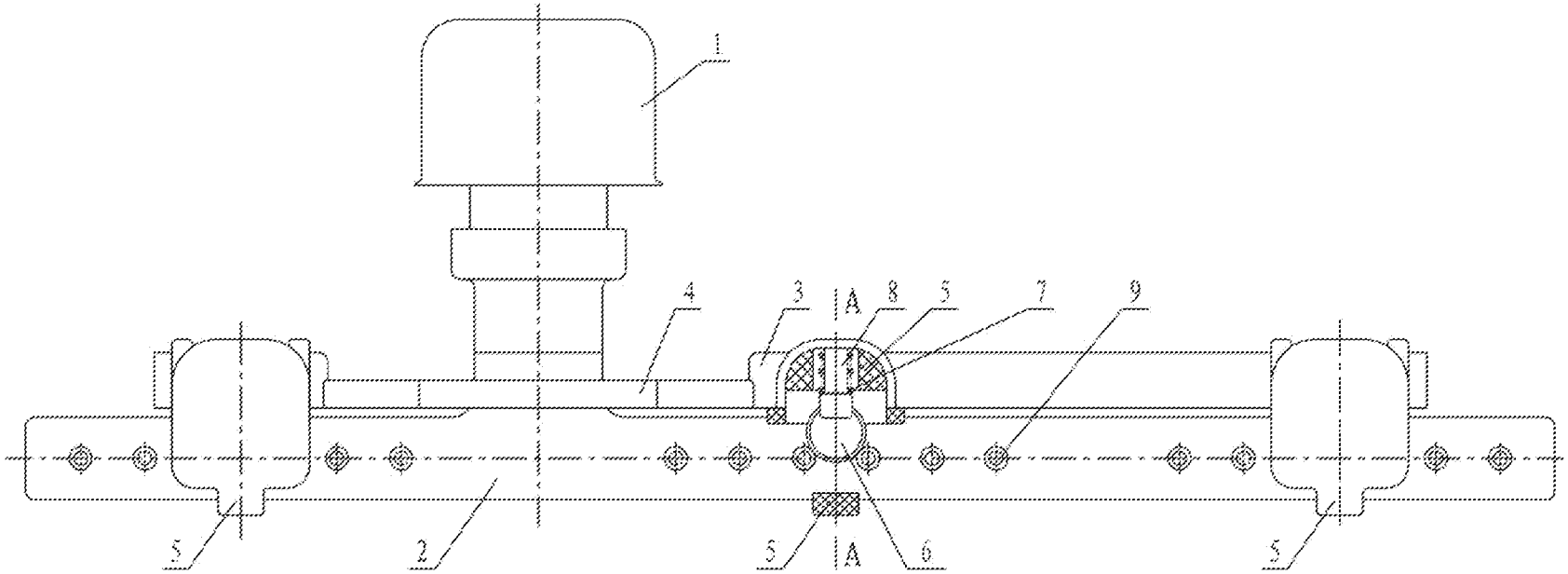
FIG. 3 is a front view of a strip type off-circuit tap changer according to a second embodiment of the present invention.
Figure 4:
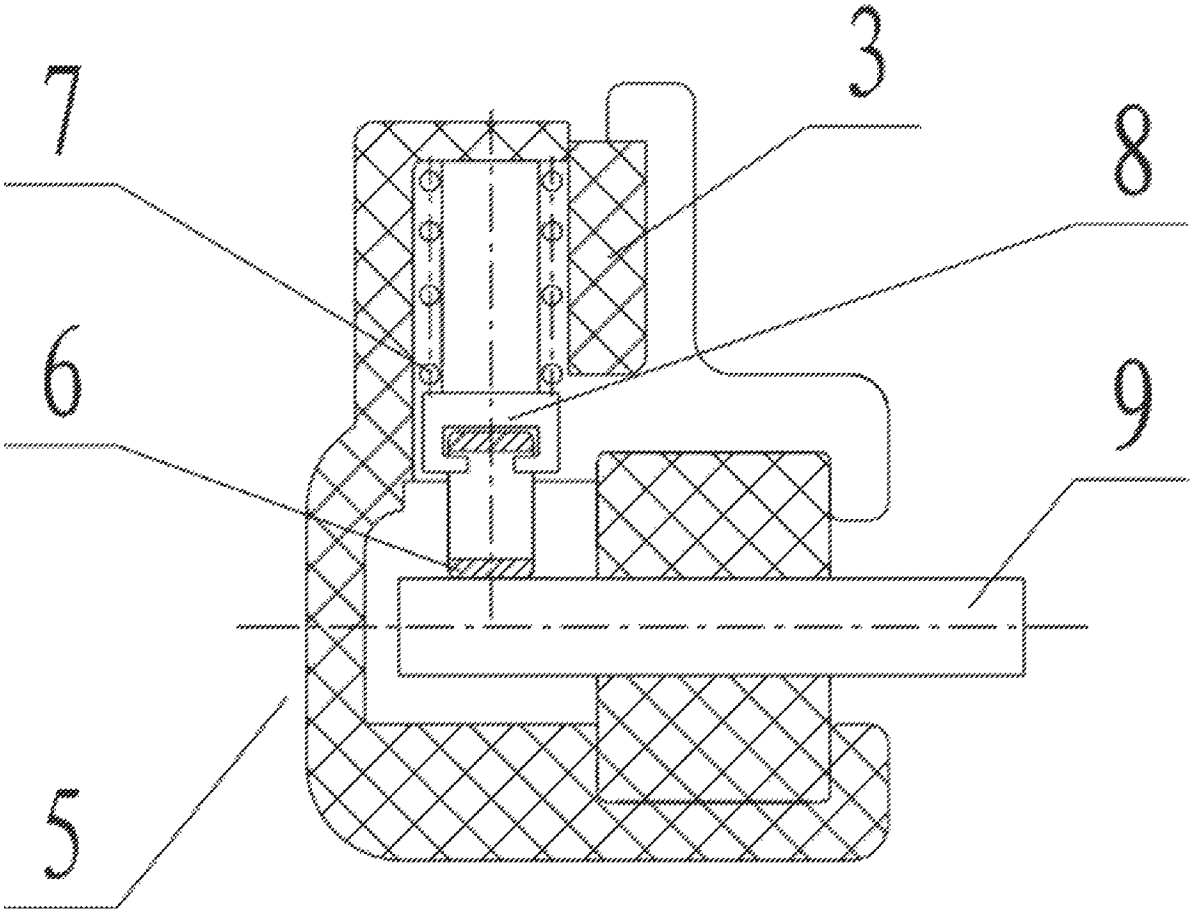
FIG. 4 is a B-B sectional view of the strip type off-circuit tap changer shown in FIG. 3.

The strip type off-circuit tap changer according to a second embodiment of the present invention is shown in FIGS. 3 and 4. The difference between the strip type off-circuit tap changer according to this embodiment and the strip type off-circuit tap changer according to the first embodiment lies in that the elastic pin is arranged outside the annular moving contact 6. In this embodiment, the elastic pin is formed of a sliding pin 8 and a return spring 7, an end head with a large diameter is disposed at a front end of the sliding pin, and an arc sliding slot is disposed on the end head and fits with the annular moving contact. The annular moving contact closely contacts the columnar fixed contact by imposing a radial elastic force on an outer ring of the annular moving contact, and rolls at the same time when longitudinally moving.

Figure 5:
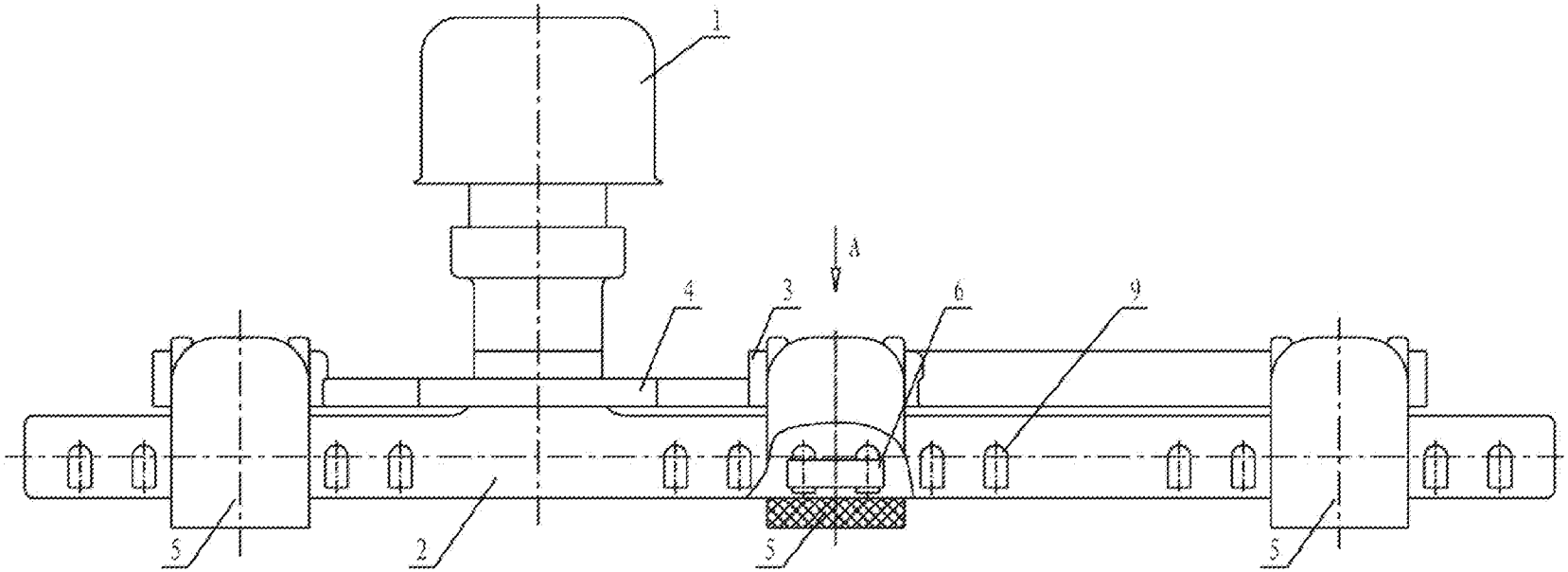
FIG. 5 is a front view of a strip type off-circuit tap changer according to a third embodiment of the present invention.
Figure 6:
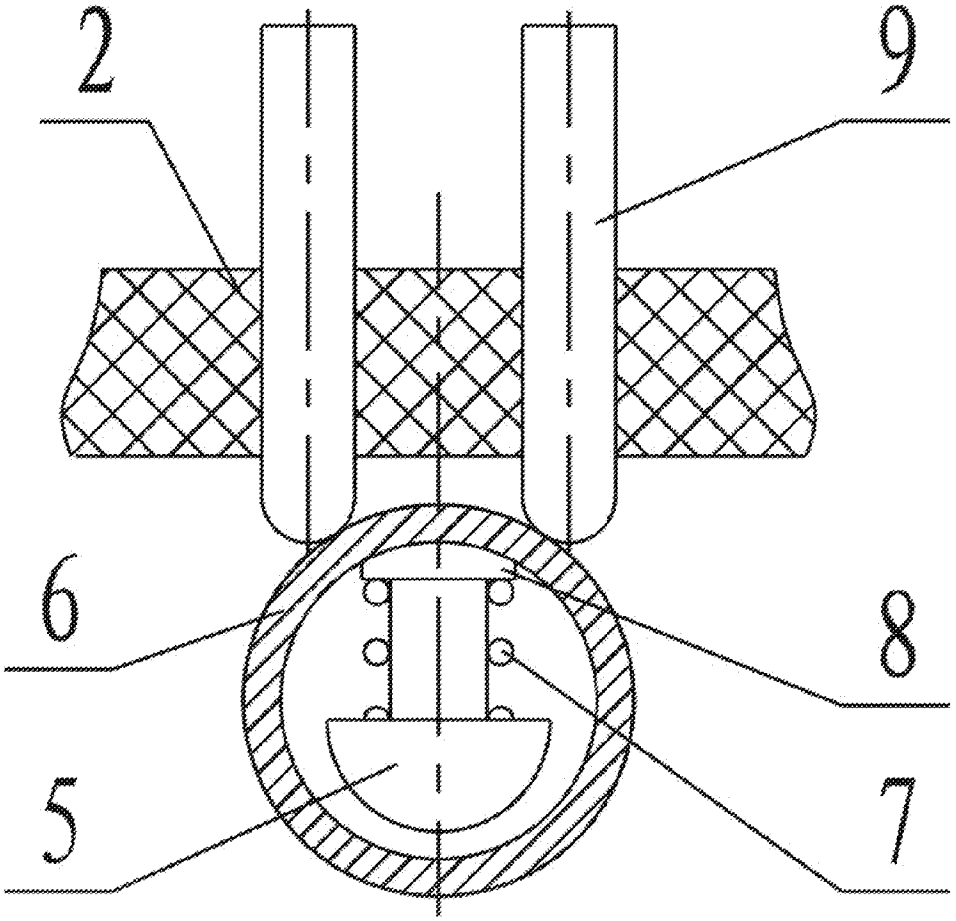
FIG. 6 is an A-direction sectional view of the strip type off-circuit tap changer shown in FIG. 5.

The strip type off-circuit tap changer according to a third embodiment of the present invention is shown in FIGS. 5 and 6. The difference between the strip type off-circuit tap changer according to this embodiment and the strip type off-circuit tap changer according to the first embodiment lies in the structure of the columnar fixed contact 9. In this embodiment, the columnar fixed contact 9 is bent and L-shaped, one end thereof is bent upwards when penetrating the insulating rod, and a bent end of the columnar fixed contact is parallel to a side wall of the insulating rod 2. The moving contact assembly is also correspondingly change. The annular moving contact is arranged at an outer side of the end, bent upwards, of the columnar fixed contact, and an axis of the annular moving contact swings at 90° to change from a horizontal direction to a vertical direction. The elastic pin is arranged in the annular moving contact, so that the moving contact corresponds to the fixed contact front and back. Other structures are the same as those in the first embodiment.

Figure 7:
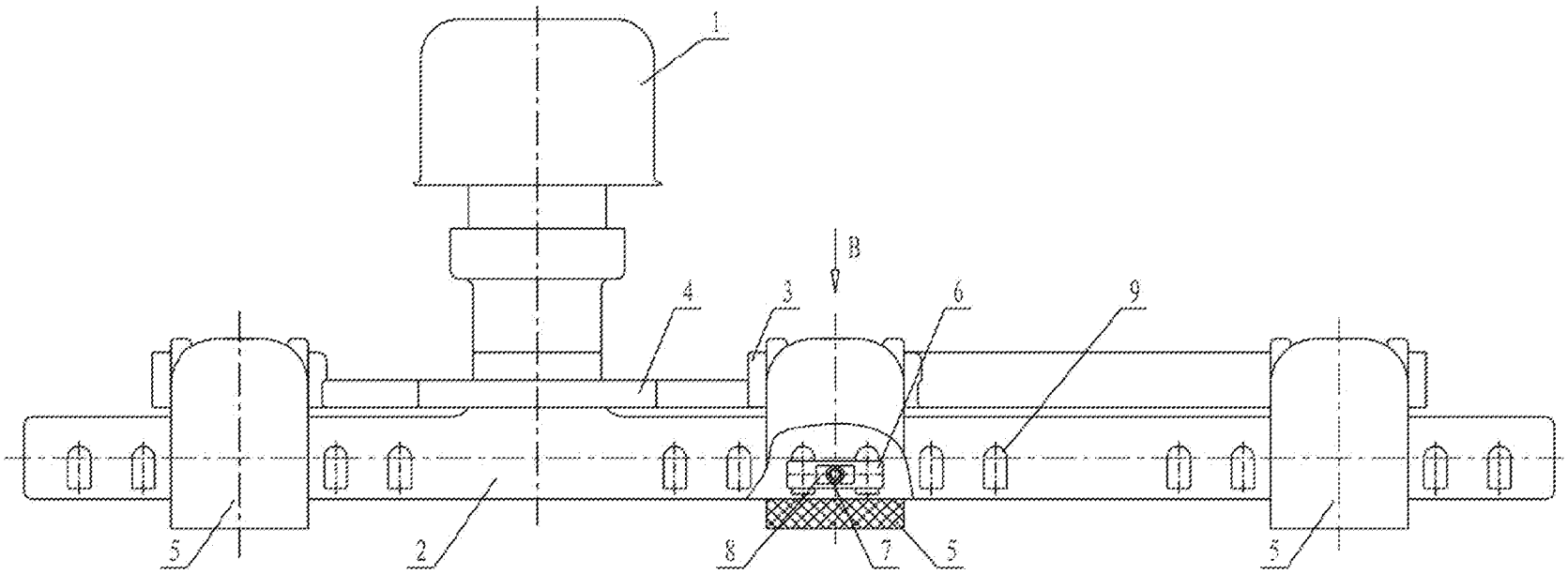
FIG. 7 is a front view of a strip type off-circuit tap changer according to a fourth embodiment of the present invention.
Figure 8:
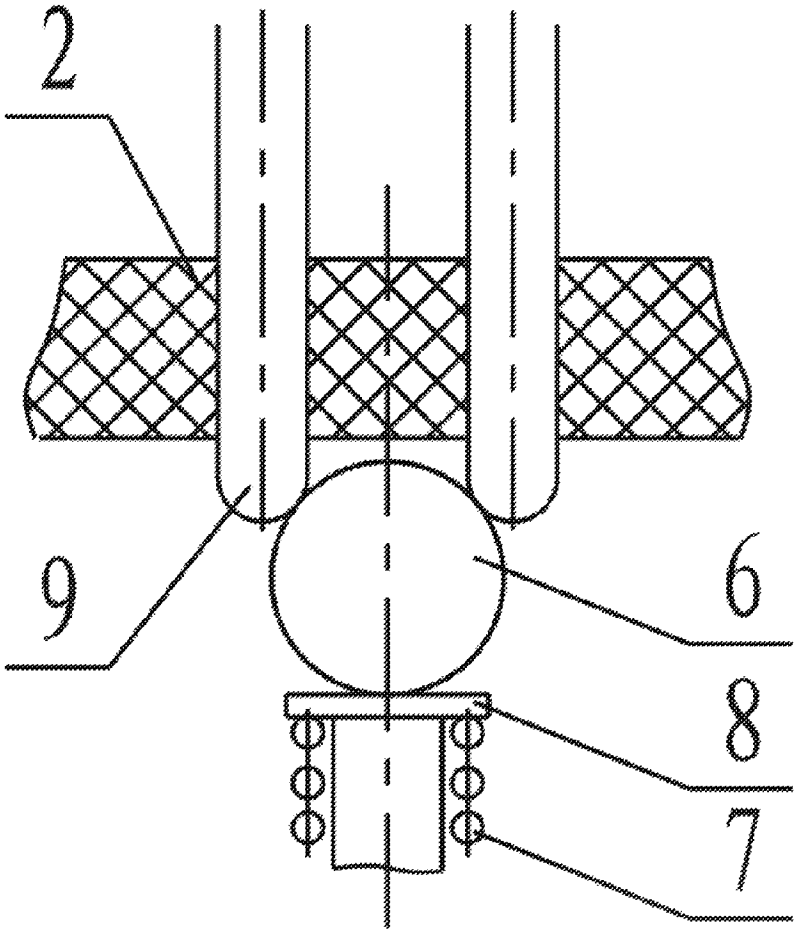
FIG. 8 is a B-direction sectional view of the strip type off-circuit tap changer shown in FIG. 7.

The strip type off-circuit tap changer according to a fourth embodiment of the present invention is shown in FIGS. 7 and 8. The difference between the strip type off-circuit tap changer according to this embodiment and the strip type off-circuit tap changer according to the second embodiment lies in the structure of the columnar fixed contact 9. In this embodiment, the columnar fixed contact 9 is bent and L-shaped, one end thereof is bent upwards when penetrating the insulating rod, and a bent end of the columnar fixed contact is parallel to a side wall of the insulating rod 2. The moving contact assembly is also correspondingly changed. The annular moving contact is arranged at an outer side of the end, bent upwards, of the columnar fixed contact, and an axis of the annular moving contact swings at 90° to change from a horizontal direction to a vertical direction. The elastic pin is arranged out of the annular moving contact, so that the moving contact corresponds to the fixed contact front and back. Other structures are the same as those in the second embodiment.

The present invention recites, among other things, strip type off-circuit tap changer, which not only reduces the frictional resistance during the moving of the moving contact, but also reduces the abrasion between the moving contact and the fixed contact. The moving contact and the fixed contact are reliably in contact with each other, so that correct positioning is achieved, and handleability is achieved during gear shifting, thereby improving the operation reliability; and the switch has a simple and compact structure and is appropriately designed.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A strip type off-circuit tap changer, comprising:

an insulating rod; and a support, wherein an operation positioning device is arranged on the support, a drive gear is disposed at a lower end of the operation positioning device and a rack mobile frame is disposed on the insulating rod, a rack of the rack mobile frame is engaged to the drive gear of the operation positioning device, columnar fixed contacts are longitudinally arranged at a spacing on the insulating rod, the rack mobile frame is connected to a moving contact frame, a moving contact assembly is arranged on the moving contact frame and fits with the fixed contact on the insulating rod, the moving contact assembly is formed by an annular moving contact and an elastic pin, the elastic pin is arranged in an inner ring of the annular moving contact, and the annular moving contact spans between two adjacent columnar fixed contacts, wherein the elastic pin is formed by a sliding pin and a return spring;

wherein a rear section of the sliding pin fits with a sliding hole of the moving contact frame, a head with a diameter larger than that of the rear section of the sliding pin at a front end of the sliding pin fits with the annular moving contact, and the return spring is sleeved outside the sliding pin; and wherein the moving contact frame is arranged with a cantilever bent downwards, a sliding slot is opened at an inner side of the cantilever and fits with a lower end of the insulating rod in a sliding manner.

2. The strip type off-circuit tap changer according to claim 1, wherein the annular moving contact substantially contacts the columnar fixed contact by imposing a radial elastic force on an inner ring.

3. The strip type off-circuit tap changer according to claim 2, wherein the columnar fixed contact is in a shape of a cylinder or a flat column.

4. The strip type off-circuit tap changer according to claim 2, wherein the columnar fixed contacts longitudinally arranged at a spacing along the insulating rod is in a shape of a straight strip, and penetrate the insulating rod; the annular moving contact is disposed at an upper side of the columnar fixed contact such that the moving contact and the fixed contact are corresponding to each other in an up-and-down form.

5. The strip type off-circuit tap changer according to claim 2, wherein the columnar fixed contacts longitudinally arranged at a spacing along the insulating rod are in a bent shape, and penetrate the insulating rod, wherein one end of each columnar fixed contact is bent upwards; the annular moving contact is disposed outside the bent end of the columnar fixed contact such that the moving contact and the fixed contact are corresponding to each other in a front-and-back form.

6. The strip type off-circuit tap changer according to claim 2, wherein an end of the columnar fixed contact is a wiring column end.

7. The strip type off-circuit tap changer according to claim 2, wherein one to three sets of columnar fixed contacts are arranged, and each set is correspondingly disposed with a moving contact assembly, to form one to three sets of tap mechanisms.

8. The strip type off-circuit tap changer according to claim 1, wherein the elastic pin is arranged out of the annular moving contact, the annular moving contact closely contacts the columnar fixed contact by imposing a radial elastic force on an outer ring.

9. The strip type off-circuit tap changer according to claim 8, wherein the columnar fixed contact is in a shape of a cylinder or a flat column.

10. The strip type off-circuit tap changer according to claim 8, wherein the columnar fixed contacts longitudinally arranged at a spacing along the insulating rod is in a shape of a straight strip, and penetrate the insulating rod; the annular moving contact is disposed at an upper side of the columnar fixed contact, and the moving contact corresponds to the fixed contact up and down.

11. The strip type off-circuit tap changer according to claim 8, wherein the columnar fixed contacts longitudinally arranged at a spacing along the insulating rod are in a bent shape, and penetrate the insulating rod, wherein one end of each columnar fixed contact is bent upwards; the annular moving contact is disposed outside the bent end of the columnar fixed contact such that the moving contact and the fixed contact are corresponding to each other in a front-and-back form.

12. The strip type off-circuit tap changer according to claim 8, wherein an end of the columnar fixed contact is a wiring column end.

13. The strip type off-circuit tap changer according to claim 8, wherein one to three sets of columnar fixed contacts are arranged, and each set is correspondingly disposed with a moving contact assembly, to form one to three sets of tap mechanisms.

* * * * *